US011296405B2

(12) United States Patent
Cho et al.

(10) Patent No.: US 11,296,405 B2
(45) Date of Patent: Apr. 5, 2022

(54) ANTENNA APPARATUS INCLUDING LENS AND COMMUNICATION METHOD USING LENS ANTENNA

(71) Applicant: KOREA ADVANCED INSTITUTE OF SCIENCE AND TECHNOLOGY, Daejeon (KR)

(72) Inventors: Dong-Ho Cho, Daejeon (KR); Yun-Sik Kim, Daejeon (KR); Lakju Sung, Daejeon (KR); Sangmi Noh, Daejeon (KR)

(73) Assignee: KOREA ADVANCED INSTITUTE OF SCIENCE AND TECHNOLOGY, Daejeon (KR)

( * ) Notice: Subject to any disclaimer, the term of this patent is extended or adjusted under 35 U.S.C. 154(b) by 834 days.

(21) Appl. No.: 16/006,113

(22) Filed: Jun. 12, 2018

(65) Prior Publication Data

US 2019/0006748 A1 Jan. 3, 2019

(30) Foreign Application Priority Data

Jun. 30, 2017 (KR) ..... 10-2017-0083083

(51) Int. Cl.

| | |
|---|---|
| ***H01Q 1/52*** | (2006.01) |
| ***H01Q 21/24*** | (2006.01) |
| ***H01Q 15/02*** | (2006.01) |
| ***H01Q 3/30*** | (2006.01) |
| ***H01Q 19/06*** | (2006.01) |
| ***H01Q 1/38*** | (2006.01) |

(52) U.S. Cl.

CPC ..... *H01Q 1/523* (2013.01); *H01Q 1/38* (2013.01); *H01Q 3/30* (2013.01); *H01Q 15/02* (2013.01); *H01Q 19/062* (2013.01); *H01Q 21/24* (2013.01)

(58) Field of Classification Search

CPC ..... H01Q 1/523; H01Q 15/02; H01Q 21/24

See application file for complete search history.

(56) References Cited

U.S. PATENT DOCUMENTS

2015/0346334 A1 12/2015 Nagaishi et al.
2016/0240923 A1* 8/2016 Oh ..... H01Q 19/062

(Continued)

FOREIGN PATENT DOCUMENTS

CN 105552551 A 5/2016
JP 2014155134 A 8/2014

(Continued)

OTHER PUBLICATIONS

Office Action issued in Korean Patent Application 10-201-0083083, dated Mar. 29, 2018.

(Continued)

*Primary Examiner* — Andrea Lindgren Baltzell
*Assistant Examiner* — Amal Patel
(74) *Attorney, Agent, or Firm* — Paratus Law Group, PLLC

(57) ABSTRACT

A lens antenna apparatus includes a plurality of antenna units and a lens structure configured to change a phase of an electromagnetic wave, emitted by at least one antenna unit among the plurality of antenna units. The lens structure changes the phase such that the overall outputs from the plurality of antenna units have different radiation patterns.

6 Claims, 9 Drawing Sheets

(56) References Cited

U.S. PATENT DOCUMENTS

| | | | | |
|---|---|---|---|---|
| 2017/0256847 | A1* | 9/2017 | Vollmer | H01Q 21/24 |
| 2018/0316090 | A1* | 11/2018 | Foo | H01Q 3/44 |

FOREIGN PATENT DOCUMENTS

| | | | |
|---|---|---|---|
| KR | 20120027985 | A | 3/2012 |
| WO | WO 2014/125716 | A1 | 8/2014 |

OTHER PUBLICATIONS

Chinese Office Action for related CN Application No. 201880035973.5 dated Oct. 10, 2020 from Chinese Intellectual Property Office.

Linshuai, "Studying on receiving technology in MIMO wireless optical communication system", Huazhong University of Science & Technology, M201172876, May 28, 2013, pp. 1-64, Wuhan, P. R. China.

* cited by examiner

FIG. 6

| | Absolute values of correlation matrices | | | | | Eigenvalues of correlation matrices |
|---|---|---|---|---|---|---|
| LENS ANTENNA | | $P_1$ | $P_2$ | $P_3$ | $P_4$ | |
| | $P_1$ | 1.000 | 0.011 | 0.728 | 0.029 | 1.6814 |
| | $P_2$ | 0.011 | 1.000 | 0.029 | 0.729 | 1.6205 |
| | $P_3$ | 0.728 | 0.029 | 1.000 | 0.022 | 1.4328 |
| | $P_4$ | 0.029 | 0.729 | 0.022 | 1.000 | 1.3936 |
| CONVENTIONAL ANTENNA | $P_1$ | 1.000 | 0.011 | 0.945 | 0.011 | 3.7824 |
| | $P_2$ | 0.011 | 1.000 | 0.011 | 0.945 | 3.7818 |
| | $P_3$ | 0.945 | 0.011 | 1.000 | 0.011 | 0.006 |
| | $P_4$ | 0.011 | 0.945 | 0.011 | 1.000 | 0.0011 |

ANTENNA APPARATUS INCLUDING LENS AND COMMUNICATION METHOD USING LENS ANTENNA

CROSS-REFERENCE TO RELATED APPLICATIONS

This application claims the benefit under 35 U.S.C. § 119(a) of Korean Patent Application No. 2017-0083083, filed on Jun. 30, 2017, in the Korean Intellectual Property Office, the entire disclosure of which is incorporated herein by reference for all purposes.

BACKGROUND

1. Field

The following description relates to a technology for an antenna apparatus that utilizes a lens structure.

2. Description of Related Art

Various techniques for increasing channel capacity in wireless communication have been studied. A traditional method of increasing the number of channels utilizes the division of time or frequency. Further, a method of increasing channel capacity using different radiation patterns or polarizations in the same frequency band was suggested. Meanwhile, various studies were conducted for obtaining improved multiple-input multiple-output (MIMO) gain using different channels.

The primary problem with an integrated antenna for MIMO gain improvement relates to a mutual coupling (mutual interference) signal between antennae in an antenna structure. Mutual coupling between antennae increases when a physical distance between the antennae decreases, and as the mutual coupling increases, each antenna experiences difficulties in transmitting an independent signal. In order to reduce mutual coupling between antennae in a MIMO antenna arrangement, a dual polarization dipole integrated antenna structure with a polarization characteristic has been suggested.

SUMMARY

Embodiments of the invention provide an antenna apparatus including a lens. Such antenna apparatus includes a plurality of antenna units and a lens structure configured to change a phase of an electromagnetic wave produced by at least one antenna unit of the plurality of antenna units. The lens structure is configured to change the phase in such a fashion that the plurality of antenna units have different radiation patterns from each other.

Embodiments of the invention also provide a communication method utilizing the use of a lens antenna. The method includes steps of outputting or emitting, by each of the plurality of antenna units, a corresponding electromagnetic wave; allowing each of the emitted electromagnetic waves to pass through a corresponding lens structure of a plurality of lens structures; and using, as a communication channel, at least two electromagnetic waves among the electromagnetic waves the phases of which have been changed by passing through the plurality of lens structures. Lens structures from the plurality of lens structures have different refractive indexes.

Embodiments additionally provide a communication method making use of a lens antenna and including: outputting or forming, by each antenna unit of a plurality of antenna units, a corresponding initial electromagnetic wave; allowing some of the so-formed electromagnetic waves antennae to pass through a lens structure; and using, as a communication channel, at least two electromagnetic waves among the initial electromagnetic waves and the electromagnetic waves that phases of which have been changed as a result of passing through the lens structure.

Advantageous Effects

The use of the following embodiments results in increase of the channel capacity of a multiple antenna system due to the use of a lens in an integrated antenna causing a reduction of a level of correlation between individual antennae. The embodiments facilitate generation of different channels with the use of the same type of antenna and contribute to effective multiple-input multiple-output (MIMO) gain on the basis of an integrated antenna having a simple structure.

BRIEF DESCRIPTION OF THE DRAWINGS

FIG. 6 is a table analyzing a correlation level of a 4-port integrated antenna including a lens structure.

Figure 1:
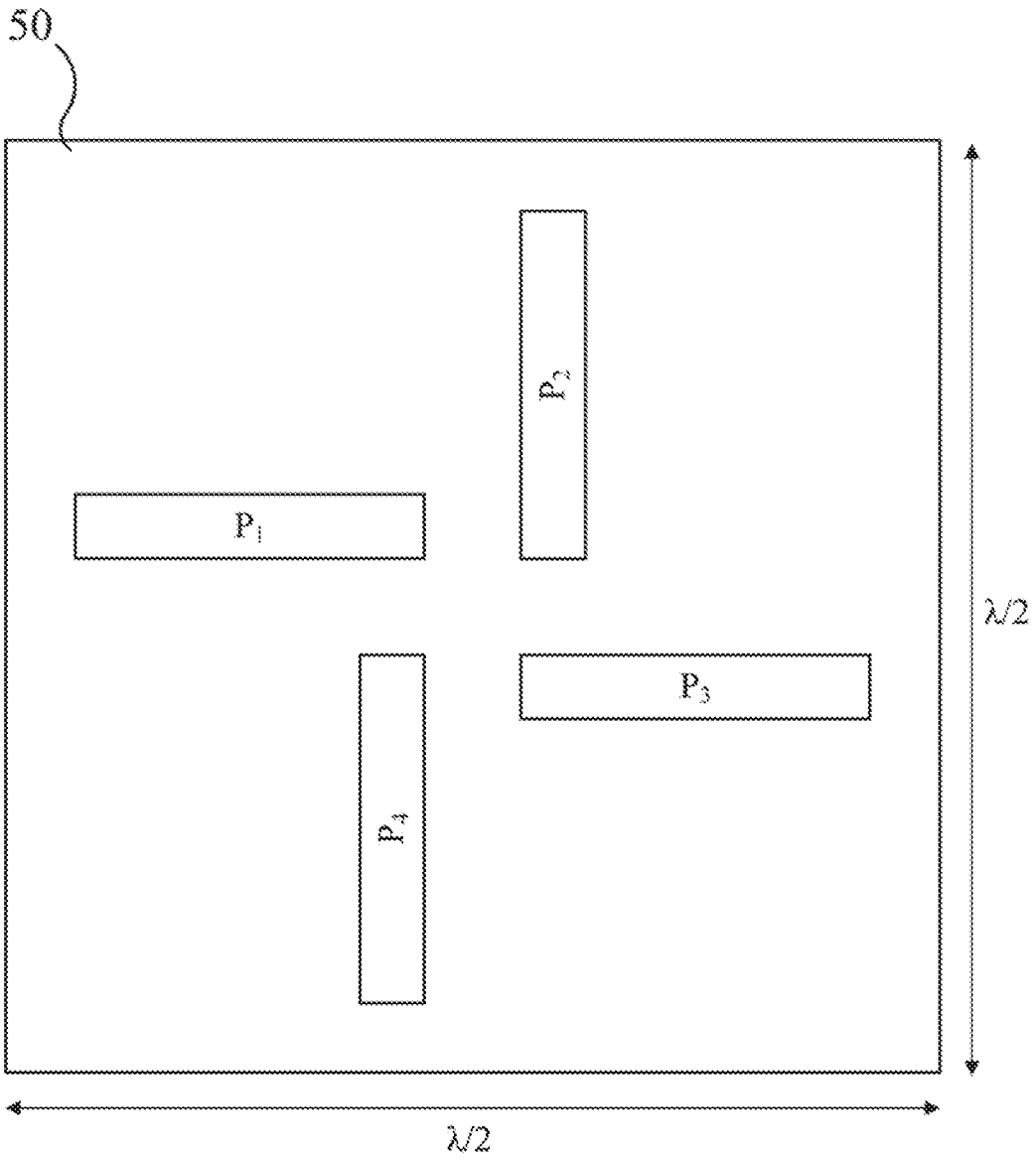
FIG. 1 illustrates an example of a conventional 4-port integrated antenna.

Throughout the drawings and the description, unless otherwise described, the same drawing reference numerals are understood to refer to the same elements, features, and structures. The relative size and depiction of these elements may be exaggerated and/or generally changed for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

Meanwhile, terminology used herein will be understood as follows. Although the terms "first," "second," etc. may be used herein to describe various elements, these elements should not be limited by these terms. These terms are only used to distinguish one element from another. For example, a first element could be termed a second element, and, similarly, a second element could be termed a first element.

As used herein, the singular forms are intended to include the plural forms as well, unless the context indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof. It should also be noted that in some alternative implementations, the processes noted in the blocks may occur out of the order noted in the flowcharts, unless the context clearly indicates a specific order. In other words, respective processes may be executed in a specified order, executed substantially concurrently, or executed in the reverse order.

Unless otherwise defined, terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The technology described below relates to an antenna apparatus including a lens structure. The antenna apparatus descried below generally includes a plurality of antenna units. A single antenna unit emits electromagnetic waves having a specific radiation pattern. The antenna apparatus described below has a structure in which a plurality of antenna units are integrated into a single apparatus. The antenna apparatus may be a two-dimensional planar antenna or a three-dimensional planar antenna. For the sake of convenience of description, the following description will be made in relation to a two-dimensional planar antenna.

FIG. 1 shows an example of a conventional 4-port integrated antenna 50. The antenna 50 includes a plurality of antenna units $P_1$, $P_2$, $P_3$, and $P_4$. The antenna 50 is provided in a form in which the antenna units $P_1$, $P_2$, $P_3$, and $P_4$ with a general deviation angle are each rotated at an interval of 90 degrees. The antenna units $P_1$ and $P_3$ are antennae having substantially the same or similar polarization characteristics (for example, each of the antennae $P_1$, $P_3$ is a V-pol antenna), and the antenna units $P_2$ and $P_4$ are antennae having substantially the same or similar polarization characteristics (for example, each of the antennae $P_2$, $P_4$ is an H-pol antenna). In the case of having the integration structure of the antenna 50, antenna units having an interval of 90 degrees (for example, $P_1$ and $P_2$) have a low correlation level, but antenna units having an interval of 180 degrees (for example, $P_1$ and $P_3$) have a high correlation level due to the polarization component. Here, the term level of correlation level refers to a correlation level of radiation patterns output (formed) by antennae. Antenna units having a high level of correlation (for example, $P_1$ and $P_3$ antenna units) cause the rank of a channel matrix to be reduced. Accordingly, the antenna 50 having such an antenna unit does not ensure independence between signals, thus having causing difficulty in obtaining a multiple gain.

Figure 2:
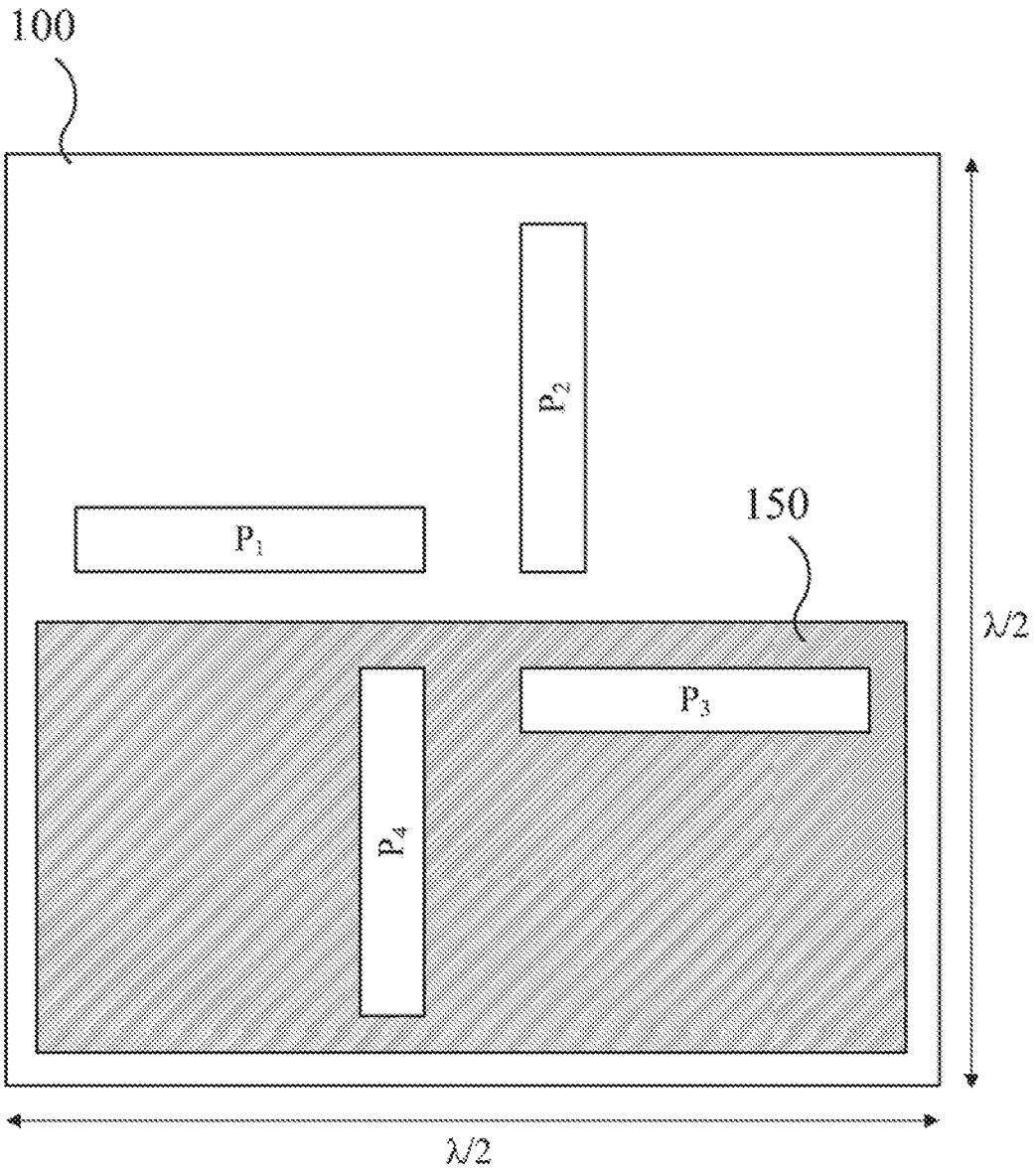
FIG. 2 provides an example of a 4-port integrated antenna including a lens structure.

FIG. 2 provides an example of a 4-port integrated antenna 100 including a lens structure. The antenna 100 includes a plurality of antenna units $P_1$, $P_2$, $P_3$, and $P_4$. The antenna 100 is generally a 4-port integrated antenna having a structure similar to that shown in FIG. 1.

In addition, the antenna 100 includes a lens structure 150. The lens structure 150 is made of a dielectric having a specific permittivity. The lens structure 150 is preferably made of a dielectric having at least one of a permittivity and permeability greater than or equal to a certain value. The lens structure 150 may be dimensioned in a variety of shapes. In one specific example, the lens structure 150 may have a planar shape (such as a substrate) with a constant thickness. For the sake of convenience of description, the antenna that includes a lens structure will be referred to and defined as a lens antenna. The antenna units $P_1$, $P_2$, $P_3$, and $P_4$ emit electromagnetic waves. The electromagnetic waves emitted by the antenna units pass through the lens structure 150. The antenna 100 has a structure in which electromagnetic waves emitted by only some antenna units $P_3$ and $P_4$ pass through the lens structure 150. The lens structure 150 is disposed at a position, in which only electromagnetic waves emitted by the antenna units $P_3$ and $P_4$ pass through the lens structure 150.

Figure 3:
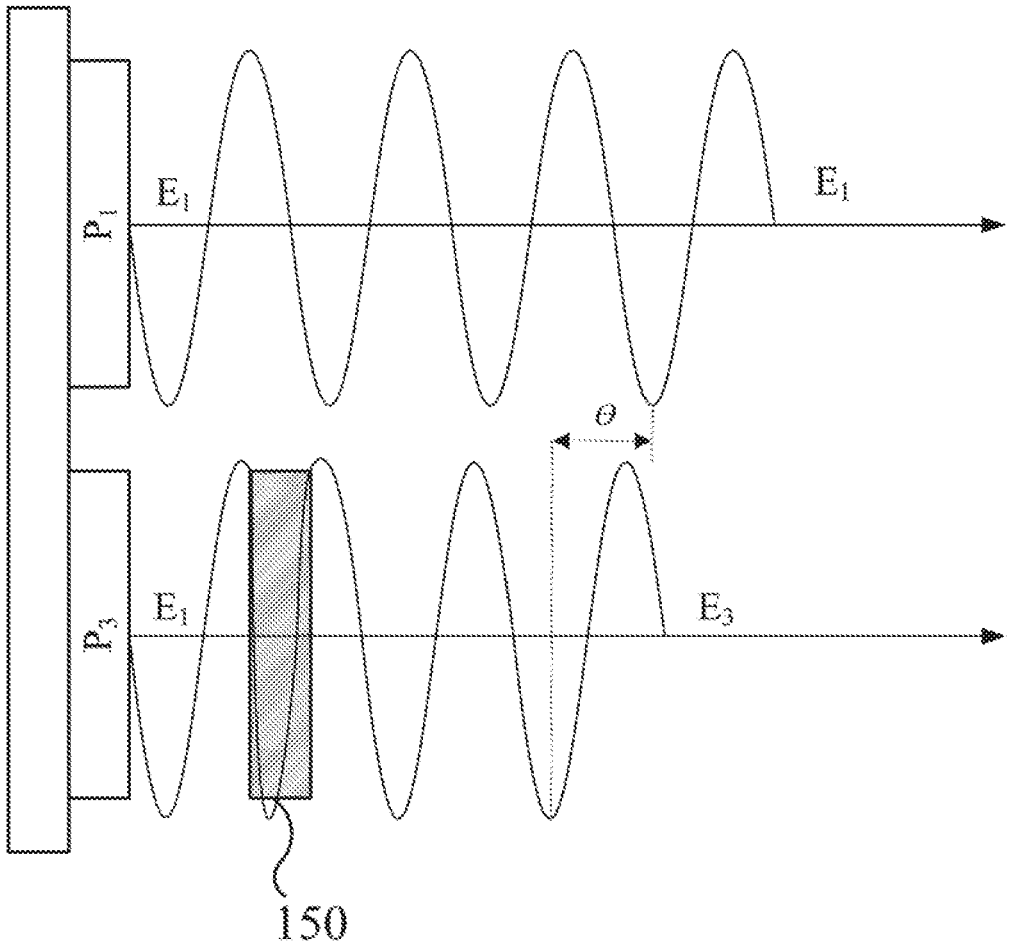
FIG. 3 illustrates an example of electromagnetic waves passing through a lens structure.

FIG. 3 shows an example of electromagnetic waves passing through a lens. FIG. 3 illustrates an example of electromagnetic waves emitted by the antenna units $P_1$ and $P_3$ in the antenna 100. It is assumed that the antenna units $P_1$ and $P_3$ generally output (emit) electromagnetic waves $E_1$ with the same radiation pattern.

Since an electromagnetic wave signal is generally represented by a complex number or numbers, the signal transmitted through the lens contains not only a magnitude but also phase information. When phase information is changed, an envelope correlation coefficient ρ (defined as a correlation level between antenna radiation patterns in Equation 1) has a reduced numerator thereof, and thus the degree of antenna correlation is reduced. As a result, the rank of a channel matrix H including interference between antennae is improved, and thus the channel capacity is improved.

$$\rho = \frac{\left|\iint \overline{F_1} \cdot \overline{F_2^*} d\Omega\right|^2}{\iint |\overline{F_1}|^2 d\Omega \cdot \iint |\overline{F_2}|^2 d\Omega} \quad \text{[Equation 1]}$$

The antenna unit $P_1$ outputs or emits an electromagnetic wave having a wavelength $d_1$, and the antenna unit $P_3$ also outputs an electromagnetic wave having the wavelength $d_1$. When the lens structure 150 is disposed in front of the antenna unit $P_3$ and when the losses on propagation of the electromagnetic wave through the lens are ignored, a signal of an electromagnetic wave generated by the antenna unit $P_3$ is affected by the thickness of the lens structure 150, and phase information of the electromagnetic wave is changed. The electromagnetic wave output by the antenna unit $P_3$ slows down during propagation through in the lens structure 150. Accordingly, the electromagnetic wave $E_3$ that has passed through the lens structure 150 has a constant phase difference θ when compared to the electromagnetic wave $E_1$ emitted by the antenna unit $P_1$. In this manner, the antenna 100 reduces the level of correlation between the antenna units (for example, $P_1$ and $P_3$) when the lens structure 150 is used, thereby increasing the channel capacity.

Figure 4:
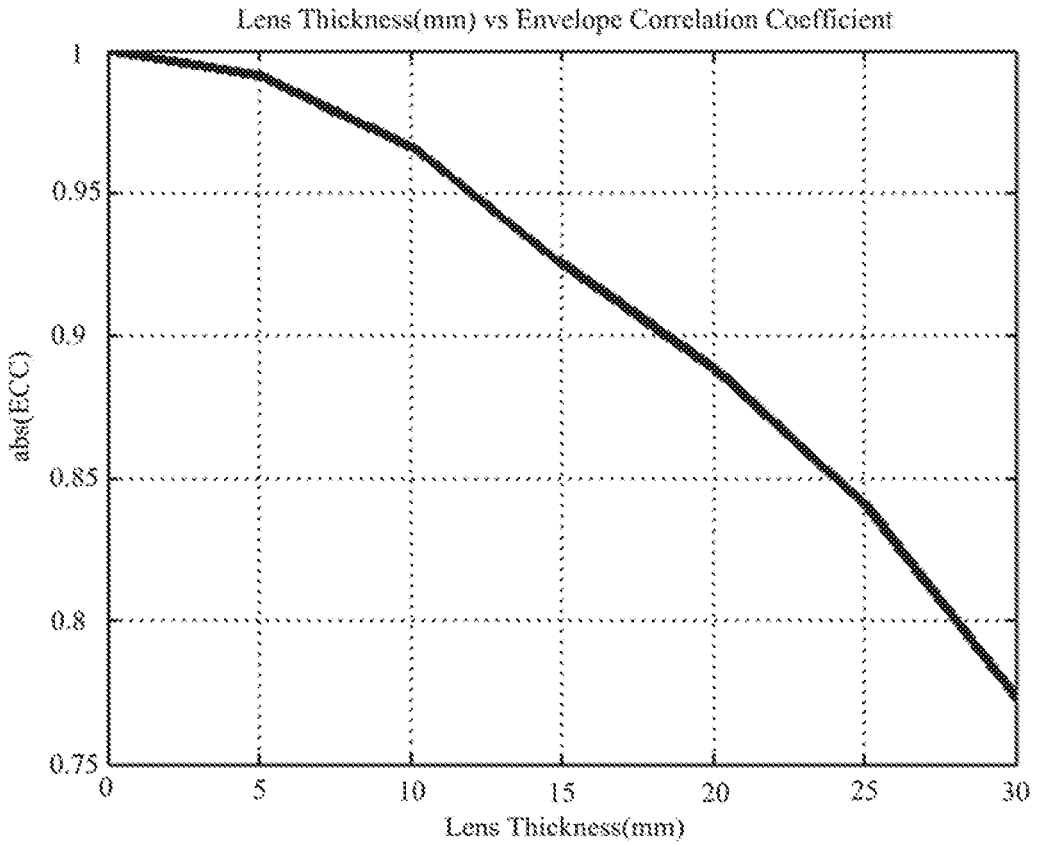
FIG. 4 is a graph showing a relationship between the thickness of a lens structure and a level of correlation of radiation patterns.

Referring to the example shown in FIG. 2, when the thickness of the lens structure 150 having a constant permittivity in the antenna 100 varies, the correlation level between the radiation patterns emitted by the antenna units (for example, $P_1$ and $P_3$) is also varied. FIG. 4 shows an example of a graph showing a relationship between the thickness of the lens structure 150 and a correlation level of radiation patterns. As the thickness of the lens structure 150 becomes thicker, the effect of a decrease in correlation level becomes larger. This is because a greater thickness of the lens structure 150 causes a larger degree of change in phase information of electromagnetic waves passing through the lens structure 150.

FIG. 4 is an example of a graph showing a relationship between the thickness of the lens structure 150 and a decrease in correlation level.

The material forming the lens structure 150 affects a correlation level of radiation patterns. For example, when the refractive index of a dielectric forming the lens structure 150 increases, the correlation level of the radiation patterns decreases in proportion to the increasing refractive index. To summarize, the material and thickness of the lens structure 150 has an influence on decreasing the degree of radiation pattern correlation.

Figure 5:
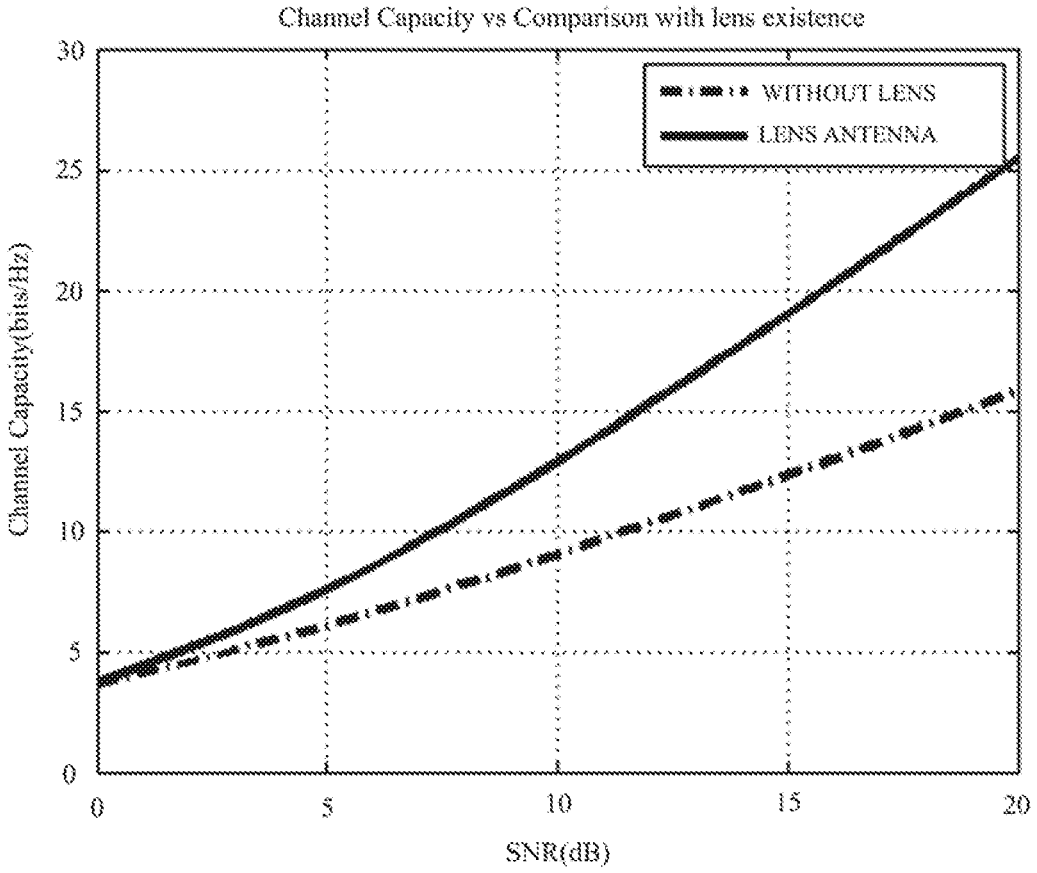
FIG. 5 provides a graph showing channel capacity of a 4-port integrated antenna including a lens structure.

FIG. 5 shows an example of a graph showing channel capacity of a 4-port integrated antenna including a lens structure. FIG. 5 illustrates the extent to which channel capacity is increased by decreasing a correlation level. The simulation is obtained under the assumption of full scattering and non-line-of-sight (NLOS) environments. The total channel matrix H is expressed as Equation 2 below.

$$H=R_t^{1/2}H_wR_1^{1/2} \quad \text{[Equation 2]}$$

When a correlation matrix element $R_{t,(ij)}=\rho_{(ij)}$, matrices $R_t$ and $R_r$ contribute to the improvement of the rank of the total channel H, separately from an environment channel matrix of a system Hw. Even though the effectiveness is slightly reduced in a line-of-sight (LOS) environment, a change in a phase caused by the lens structure improves the independence between antenna signals, such that the ranks of the matrices $R_t$ and $R_r$ are improved and the channel capacity is increased.

FIG. 6 shows an example of a table for analyzing a correlation level of a 4-port integrated antenna including a lens structure. FIG. 6 shows an example in which the correlation level of the antenna including the lens structure and the correlation level of a conventional antenna are analyzed. It is assumed that the lens antenna uses a FR-4 substrate having a thickness of 3 cm as a lens. FIG. 6 shows absolute values of the correlation matrices of the conventional antenna and the lens antenna. FIG. 6 also shows eigenvalues obtained by performing a singular value decomposition on the correlation matrices. Referring to FIG. 6, it can be seen that the correlation level of the lens antenna is significantly lower than that of the conventional antenna.

The lens antenna changes phase information of electromagnetic waves output by the antenna unit by using the lens structure. Accordingly, the channel capacity of the integrated antenna is increased. The channel capacity is increased in two aspects. One is the addition of a channel by varying radiation patterns emitted by a plurality of antenna units. The other one is the expansion of a channel by reducing interference between electromagnetic waves emitted by a plurality of antenna units. FIGS. 7A, 7B, 7C, and 7D show examples illustrating a structure of a lens antenna. An antenna 200 shown in FIG. 7A includes four antenna units $P_1$, $P_2$, $P_3$, and $P_4$ and a lens structure 250. The antenna units $P_1$, $P_2$, $P_3$, and $P_4$ may be antennae of which some have the same polarization characteristics or similar polarization characteristic to each other. Alternatively, the antenna units $P_1$, $P_2$, $P_3$, and $P_4$ may be antennae of which some have the same radiation patterns or similar radiation patterns to each other. For example, the antenna units $P_1$ and $P_3$ may have the same polarization characteristic or the same radiation pattern. In addition, the antenna units $P_2$ and $P_4$ may have the same polarization characteristic or the same radiation pattern. In this case, the lens structure 250 may be used only for the antenna units $P_3$ and $P_4$. The lens structure 250 has a placement in which the lens structure 250 allows only electromagnetic waves of the antenna units $P_3$ and $P_4$ to pass therethrough. The antenna 200 with the above described structure has a correlation level reduced between the antenna units $P_1$ and $P_3$ (or the antenna units $P_2$ and $P_4$) so that the channel capacity is increased.

It is assumed that the antenna units $P_1$ and $P_3$ emit electromagnetic waves with a first radiation pattern, and the antenna units $P_2$ and $P_4$ emit electromagnetic waves with a second radiation pattern. The antenna 200 may allow a radiation pattern emitted by the antenna units $P_3$ and $P_4$ to be changed by the lens structure 250. Accordingly, the degrees of correlation of the radiation patterns of the antenna units $P_1$, $P_2$, $P_3$, and $P_4$ are lowered.

Figure 7A:
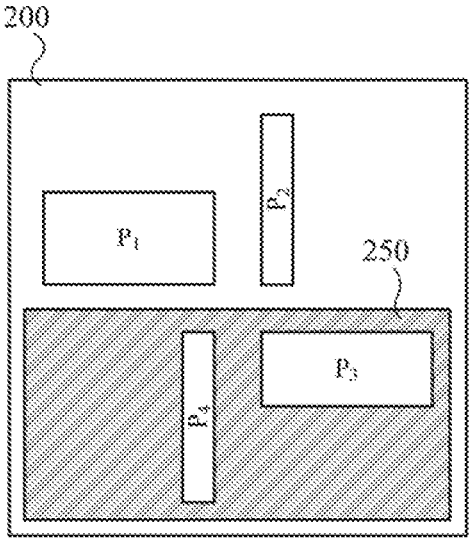
FIGS. 7A, 7B, 7C, 7D schematically illustrate a structure of a lens antenna.
Figure 7B:
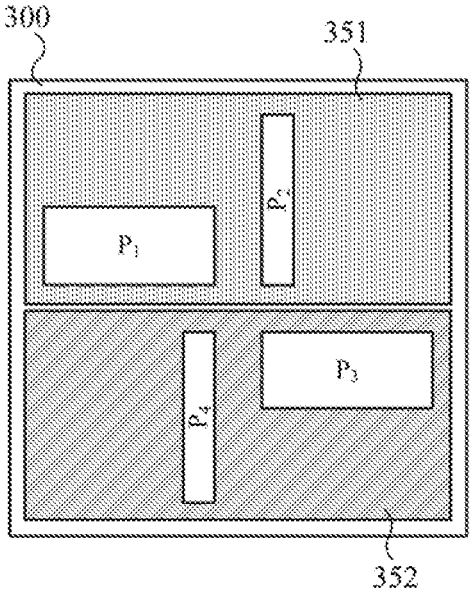

An antenna 300 shown in FIG. 7B includes four antenna units $P_1$, $P_2$, $P_3$, and $P_4$ and two lens structures 351 and 352. Similar to FIG. 2, the antenna units $P_1$, $P_2$, $P_3$, and $P_4$ may be antennae of which some have the same polarization characteristics or similar polarization characteristics to each other. Alternatively, the antenna units $P_1$, $P_2$, $P_3$, and $P_4$ may be antennae of which some have the same radiation patterns or similar radiation patterns to each other. For example, the antenna units $P_1$ and $P_3$ may have the same polarization characteristic or the same radiation pattern. In addition, the antenna units $P_2$ and $P_4$ may have the same polarization characteristic or the same radiation pattern. The lens structure 351 and 352, which are different from each other, are respectively applied to the antenna units $P_1$ and $P_2$ and the antenna units $P_3$ and $P_4$. The lens structures 351 and 352 are structures having different refractive indexes from each other. In this case, the lens structures 351 and 352 change phase information of electromagnetic waves of "$P_1/P_2$" and phase information of electromagnetic waves of "$P_3/P_4$" to be the same. Accordingly, the antenna 300 with the above described structure has a correlation level between the antenna units $P_1$ and $P_3$ (or the antenna units $P_2$ and $P_4$) reduced so that the channel capacity is increased.

Figure 7C:
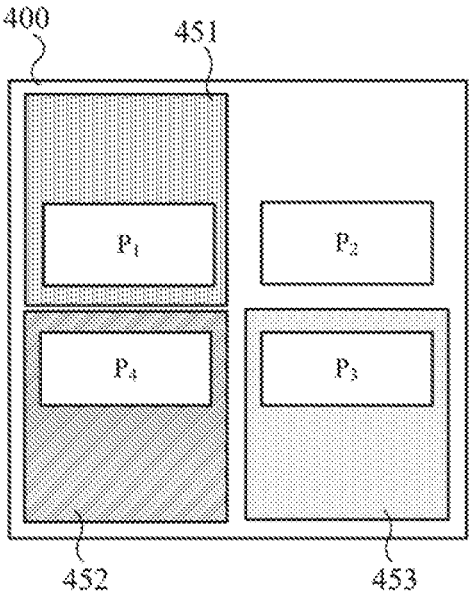

An antenna 400 shown in FIG. 7C includes four antenna units $P_1$, $P_2$, $P_3$, and $P_4$ and three lens structures 451, 452, and 453. All of the antenna units $P_1$, $P_2$, $P_3$, and $P_4$ may have the same polarization characteristics or similar polarization characteristics to each other. Alternatively, all of the antenna units $P_1$, $P_2$, $P_3$, and $P_4$ may have the same radiation patterns or similar radiation patterns to each other. In the antenna 300, the lens structures 451, 452, and 453 are used for the antenna units "$P_1$", "$P_3$," and "$P_4$", respectively. The lens structure 451, 452, and 453 are structures having different refractive indexes from each other. The lens structures 451, 452, and 453 allow phase information of an electromagnetic wave of each of the antenna units "$P_1$", "$P_3$," and "$P_4$" to be different from each other. As a result, the antenna 400 with the above described structure has reduced degrees of correlation between all of the antenna units $P_1$, $P_2$, $P_3$, and $P_4$.

Figure 7D:
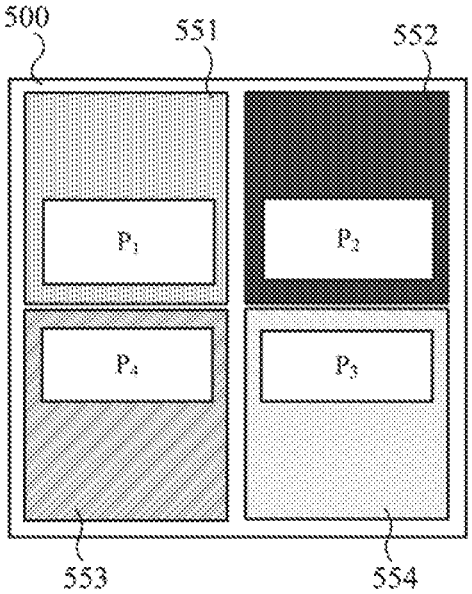

An antenna 500 shown in FIG. 7D includes four antenna units $P_1$, $P_2$, $P_3$, and $P_4$ and four lens structures 551, 552, 553, and 554. All of the antenna units $P_1$, $P_2$, $P_3$, and $P_4$ may have the same polarization characteristics or similar polarization characteristics to each other. Alternatively, all of the antenna units $P_1$, $P_2$, $P_3$, and $P_4$ may have the same radiation patterns or similar radiation patterns to each other. In the antenna 500, the lens structure 551, 552, 553, and 554 are used for the antenna units "$P_1$", "$P_2$", "$P_3$", and "$P_4$", respectively. The lens structures 551, 552, 553, and 554 are structures having different refractive indexes from each other. The lens structures 551, 552, 553, and 554 change phase information of an electromagnetic wave of each of the antenna units "$P_1$", "$P_2$", "$P_3$," and "$P_4$" to be different from each other. As a result, the antenna 500 with the above described structure has reduced degrees of correlation between all of the antenna units $P_1$, $P_2$, $P_3$, and $P_4$.

As described above, the antenna 200, 300, 400, or 500 using the lens structure may minimize interference between antenna units. Accordingly, the antenna 200, 300, 400, or 500 using the lens structure may increase the channel capacity. Further, the antenna 200, 300, 400, or 500 using the lens structure may use multiple channels using radiation patterns having different characteristics from each other. When four antenna units are provided as shown in FIG. 7, four channels may be available for use. The antenna 200, 300, 400, or 500 using the lens structure may transmit a different packet on each of the four channels. Further, the antenna 200, 300, 400, or 500 using the lens structure may perform multiple-input multiple-output (MIMO) communication using the four channels. The use of the antenna 200, 300, 400, or 500 illustrated in FIG. 7 for MIMO communication enables MIMO gain to be increased by only adding the lens structure, which is considered a relatively simple component.

Figure 8A:
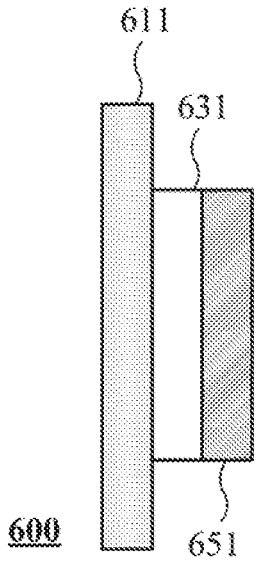
FIGS. 8A, 8B illustrate the placement of a lens in a lens antenna.
Figure 8B:
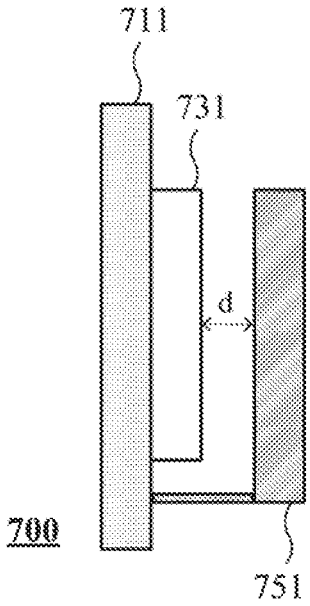

FIG. 8A, 8B show an example illustrating a placement of a lens in a lens antenna. The lens structure may have a variety of shapes. For the sake of convenience of description, it is assumed that the lens structure has a planar structure, such as a substrate. For the sake of convenience of description, a single antenna unit and a single lens structure are illustrated in FIG. 8A, 8B.

FIG. 8A shows an example illustrating the structure of a lens antenna 600. The lens antenna 600 includes a substrate 611, an antenna unit 631, and a lens structure 651. The antenna unit 631 has the form of a flat panel stacked on the substrate 611. The lens structure 651 has the form of a flat panel stacked on the antenna unit 631. The lens structure 651 may be disposed to be in contact with the antenna unit as shown in FIG. 8A.

FIG. 8B shows an example illustrating the structure of a lens antenna 700. The lens antenna 600 includes a substrate 711, an antenna unit 731, and a lens structure 751. The antenna unit 731 has the form of a flat panel stacked on the substrate 711. The lens structure 751 is disposed to be spaced a predetermined distance d from the antenna unit 731, differently from the structure shown in FIG. 8A. In order to have the antenna unit 731 spaced apart by a predetermined distance, various physical structures may be used. For example, a column-shaped structure may support the lens structure 751 as shown in FIG. 8B.

Figure 9:
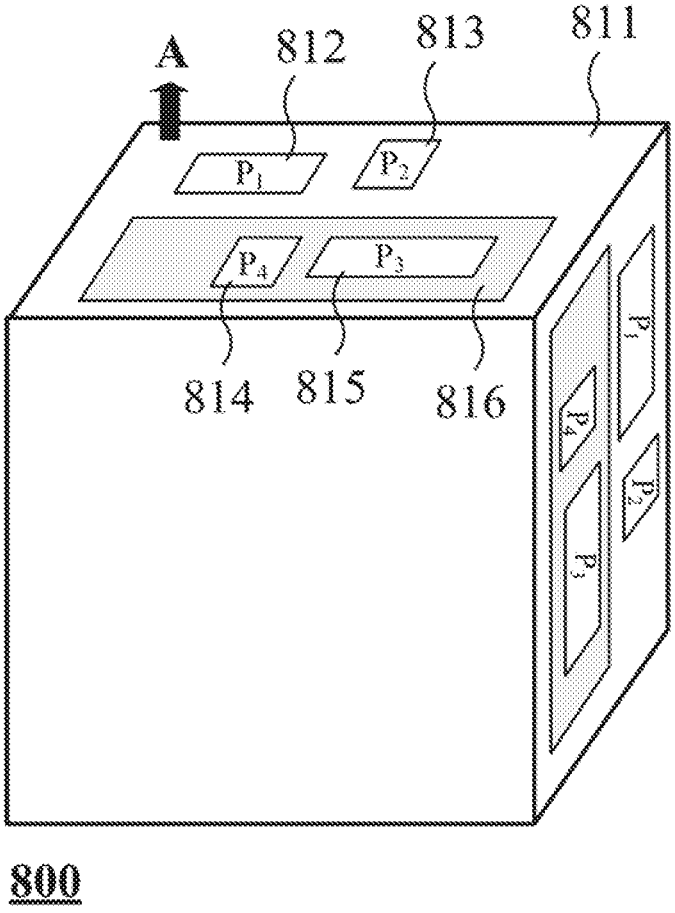
FIG. 9 provides a related illustration of a placement of a lens in a lens antenna.

Meanwhile, the antenna may have a three-dimensional structure rather than a two-dimensional structure. FIG. 9 shows an example illustrating a placement of a lens in a lens antenna 800. FIG. 9 shows an example of a three-dimensional antenna. The lens antenna 800 includes a plurality of surfaces. One surface A has a lens antenna structure similar to that shown in FIG. 7A. For example, antenna units $P_1$ and $P_3$, i.e., 812 and 815, may have the same polarization characteristic or the same radiation pattern. In addition, antenna units $P_2$ and $P_4$, i.e., 813 and 814, may have the same polarization characteristic or the same radiation pattern. In this case, a lens structure 816 may be used only for the antenna units $P_3$ and $P_4$, i.e., 815 and 814. The lens structure 816 has a placement in which the lens structure 816 allows only electromagnetic waves of the antenna units $P_3$ and $P_4$, i.e., 815 and 814, to pass therethrough. For the sake of convenience of description, reference numbers are marked only for the antenna structure on one surface of the lens antenna 800 in FIG. 9.

In addition, an antenna structure similar to the above structure may be provided in another one of the plurality of surfaces of the lens antenna 800, differently from FIG. 9. Meanwhile, the lens antenna 800 may have the same structures or similar structures on other surfaces of the lens antenna 800. For example, the lens antenna 800 may be provided with an antenna having the same structure on each surface thereof. In addition, in order to remove interference additionally occurring due to the three-dimensional structure, the lens antenna 800 may use a lens structure in any one of a plurality of antennae in which interference occurs to a large degree.

An antenna having a lens structure has been described. The above-described lens antenna remarkably increases the channel capacity in an environment having a high MIMO gain (non-line-of-sight (NLOS), high scattering ratio). The lens antenna increases the channel capacity through a simple structure, that is, a lens structure. The lens antenna allows signals to be distinguished on the basis of phase information of a radiation pattern of an antenna unit. Accordingly, the above described lens antenna enables integration of antennae with a low correlation level, without changing physical properties, such as the direction of a radiation pattern or the intensity of a signal.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An antenna apparatus including a plurality of lens structure, the antenna apparatus comprising:

a plurality of antenna units; and the plurality of lens structure configured to change a phase of an electromagnetic wave emitted by at least one antenna unit of the plurality of antenna units, wherein the plurality of lens structure is configured to differ radiation patterns of the plurality of antenna units from each other without changing directions of the radiation patterns, wherein the plurality of antenna units includes three antenna units including a first antenna unit, a second antenna unit, and a third antenna unit and configured to emit electromagnetic waves which have the same polarizations or the same radiation patterns, wherein the plurality of lens structure includes a first lens structure applied to the first antenna unit and a second lens structure applied to the second antenna unit, wherein the third antenna unit emits a radiation pattern without a lens structure, wherein the first lens structure and the second lens structure lower a correlation level of two radiation patterns of the two antenna units by differing phases of electromagnetic waves without changing directions of the radiation patterns emitted from the first antenna unit and the second antenna unit from each other, and wherein refractive indices of the first lens structure and the second lens structure are different from each other.

2. The antenna apparatus of claim 1, wherein the plurality of lens structure is attached to or spaced by a predetermined distance from the at the least one antenna unit.

3. A method for communication using a lens antenna, the method comprising:

emitting, by each antenna units of a plurality of antenna units including a first antenna unit, a second antenna unit, and a third antenna unit, a corresponding electromagnetic wave;

changing a phase of each of electromagnetic waves by passing each of the electromagnetic waves through a corresponding lens structure of a plurality of lens structures including a first lens structure applied to the first antenna unit and a second lens structure applied to the second antenna unit; and forming communication channels with two electromagnetic waves passing through corresponding lens structures and one electromagnetic wave emitted by the third antenna unit without a lens structure, wherein the first antenna unit and the second antenna unit are configured to emit electromagnetic waves which have the same polarizations or the same radiation patterns, and wherein the two electromagnetic waves have different radiation patterns from each other after passing through the corresponding lens structures without changing directions of the radiation patterns, wherein the first lens structure and the second lens structure lower a correlation level of two radiation patterns by differing phases of the electromagnetic waves without changing directions of the radiation patterns emitted from the first antenna unit and the second antenna unit from each other, and wherein refractive indices of the first lens structure and the second lens structure are different from each other.

4. The method of claim 3, further comprising:

performing a multiple-input multiple-output (MIMO) scheme communication with the two electromagnetic waves.

5. A method for communication using a lens antenna, the method comprising:

emitting, by each of a plurality of antenna units including a first antenna unit; a second antenna unit, and a third antenna unit, a corresponding initial electromagnetic wave;

changing phases of some of the initial electric waves by transmitting some of the initial electromagnetic waves through a plurality of lens structure including a first lens structure applied to the first antenna unit and a second lens structure applied to the second antenna unit; and forming communication channels with two electromagnetic waves of two antenna units of the plurality of antenna units and one initial electromagnetic wave emitted by the third antenna unit without a lens structure, wherein the two antenna units of the plurality of antenna units are configured to emit electromagnetic waves which have the same polarizations or the same radiation patterns, wherein the two electromagnetic waves of the two antenna units have different radiation patterns without changing directions of the radiation patterns from each other as a result of said transmitting through the plurality of lens structure, wherein the first lens structure and the second lens structure lower a correlation level of two radiation patterns by differing phases of the electromagnetic waves without changing directions of the radiation patterns emitted from the first antenna unit and the second antenna unit from each other, and wherein refractive indices of the first lens structure and the second lens structure are different from each other.

6. The method of claim 5, further comprising performing a multiple-input multiple-output (MIMO) scheme communication using the two electromagnetic waves.

* * * * *